United States Patent [19]

Walther

[11] Patent Number: 4,796,619

[45] Date of Patent: * Jan. 10, 1989

[54] LUNG-CONTROLLED VALVE FOR RESPIRATOR MASKS HAVING POSITIVE PRESSURES INSIDE THE MASK

[75] Inventor: Hans-Joachim Walther, Lübeck, Fed. Rep. of Germany

[73] Assignee: Drägerwerk Aktiengesellschaft, Fed. Rep. of Germany

[ * ] Notice: The portion of the term of this patent subsequent to Aug. 19, 2003 has been disclaimed.

[21] Appl. No.: 837,089

[22] Filed: Mar. 5, 1986

[30] Foreign Application Priority Data

Mar. 7, 1985 [DE] Fed. Rep. of Germany ..... 3508130

[51] Int. Cl.[4] ..... A62B 7/04

[52] U.S. Cl. ..... 128/204.19; 128/204.26; 137/495; 251/65

[58] Field of Search ..... 128/204.19, 204.26, 128/201.28, 205.29; 137/909, 908, 495, 565.38, 565.37, 565.42, 565.40; 251/65

[56] References Cited

U.S. PATENT DOCUMENTS

| | | | |
|---|---|---|---|
| 2,704,996 | 10/1956 | Brown | 137/505.42 |
| 2,951,494 | 9/1960 | Holmes | 137/908 |
| 2,970,602 | 2/1961 | Cupp | 137/908 |
| 2,972,468 | 2/1961 | Ray | 251/65 |
| 3,039,481 | 6/1962 | Schreiber et al. | 128/204.19 |
| 3,121,552 | 2/1967 | Wilson | 251/65 |
| 3,232,303 | 2/1966 | Cupp | 137/908 |
| 3,610,237 | 10/1971 | Folkerth et al. | 128/204.26 |
| 4,606,339 | 8/1986 | Walther | 128/204.26 |

FOREIGN PATENT DOCUMENTS

| | | | |
|---|---|---|---|
| 135582 | 12/1959 | U.S.S.R. | 128/204.19 |

OTHER PUBLICATIONS

Walther, "Der neue DRAGER-Pressluftatmer PA 54 P/1800", *Dragerheft*, No. 306, pp. 16–22, (1978).

*Primary Examiner*—Kyle L. Howell
*Assistant Examiner*—K. M. Reichle
*Attorney, Agent, or Firm*—McGlew and Tuttle

[57] ABSTRACT

In known lung-controlled valves, the positive pressure in a breathing connection is established by the fact that the control diaphragm of the valve is tensioned by spring force. There, however, the opening force brought about by the spring is greatest when the inlet valve is closed, while it is smallest when the inlet valve is completely open. To keep the opening force as small as possible with the valve closed, and to leave the opening force approximately unchanged with increasing opening of the inlet valve, a magnet is provided on the inside of the housing cover of the lung-controlled diaphragm and the control diaphragm comprises a magnetizable part which is held at a minimum distance from the magnet by spacers when the inlet valve is closed.

3 Claims, 1 Drawing Sheet

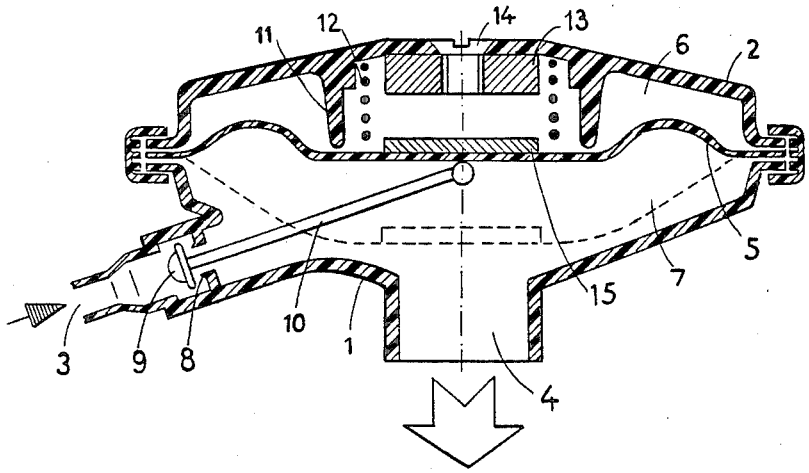
11
12
14
13
6
2
5
7
15
10
1
3
9
8
4

LUNG-CONTROLLED VALVE FOR RESPIRATOR MASKS HAVING POSITIVE PRESSURES INSIDE THE MASK

FIELD AND BACKGROUND OF THE INVENTION

This invention relates in general to respirator masks and in particular to a new and useful lung-controlled valve for a respirator mask which have a positive interior mask pressure.

A similar lung-controlled valve is known from the German Journal "Drägerheft" No. 306, pages 16–22, (1976).

The known lung-controlled valve establishes the positive pressure in the respirator mask by the fact that its control diaphragm is tensioned by spring force in such a way that on reaching a certain pressure inside the mask (static pressure), the inlet valve is closed. As soon as this given pressure is fallen short of, the inlet valve opens and supplies respiratory air until the given pressure is reached again. In the known lung-controlled valves, the spring exerts it's maximum force on the diaphragm in the position in which the valve just starts to open for establishing the static pressure. When drawing relatively large quantities of air and in particular when breathing briskly, the forces diminish due to the spring characteristic, so that at maximum diaphragm stroke and completely opened valve the smallest opening force acts on the diaphragm and hence also the least pressure prevails in the interior of the mask.

SUMMARY OF THE INVENTION

The present invention provides a valve constructed to improve a lung-controlled positive pressure valve of such devices in such a way that there is an insignificant difference between the minimum pressure still to be ensured even at full extraction and the static pressure that is required for closing the inlet valve and that must be overcome by the wearer when exhaling.

In a lung-controlled valve according to the invention, the static pressure in the respiration chamber and hence in the mask, against which exhalation must take place, can be adjusted very low because the positive pressure required for safety is maintained also with increasing air volume stream. With the inlet valve closed, the spring force of the compression spring is almost completely compensated by a magnetic force between a magnet and the steel plate. The spacers prevent too close an approach to the magnet. If the pressure in the respiration chamber decreases only slightly, the control diaphragm moves away from the magnet. The magnetic compensation force then decreases more than the compressive force of the spring, so that the forces act on the diaphragm is an opening direction, and hence the positive pressure in the respiration chamber and in the mask, remain approximately unchanged.

As magnets preferably permanent magnets, can be used. However, it is possible to use electromagnetically excited iron cores which can be actuated via a coil arrangement and a current source.

The control diaphragm is advantageously provided with a small steel plate surrounded by it.

Accordingly, it is an object of the invention to provide an improved lung-controlled valve for respirator masks which have a positive interior mask pressure in which a permanent magnet is employed for holding a control diaphragm for actuating the valve at a minimum spacing so that operation will be simple and easy.

A further object of the invention is to provide a lung-controlled valve which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

In the drawing:

The only FIGURE of the drawing is a sectional view of a lung-controlled valve constructed in accordance with the invention.

DESCRIPTION OF THE PREFERRED EMBODIMENT

Referring to the drawing in particular, the invention embodied therein comprises a lung-controlled valve for respirator masks which has a positive interior mask pressure in an interior respiration chamber which is connected to the user's respiratory organs by a connection or outlet 4 of the valve housing 1.

In the only FIGURE, a lung-controlled valve is shown in section, and comprises a housing 1 and a housing cover or outer chamber wall 2, between the edges of which a flexible control diaphragm 5 is clamped. By this control diaphragm 5 the lung-controlled valve is divided into two chambers, namely an outer chamber 6 between the control diaphragm 5 and housing cover 2 and a respiration chamber 7, the outlet 4 of which leads into the respirator mask (not shown). Protruding into the respiration chamber 7 is a valve lever 10, which by its one end touches the control diaphragm 5 and by its other end applies via the valve body 9 against the inlet valve 8 for a respiratory gas flowing in from the respiratory gas inlet on with valve passage 3. In the outer chamber 6, a compression spring 12 is disposed between the inside of the housing cover 2 and the control membrane 5, between a single cylindrical or two or more arcuate or rectangular two spacers 11. The spring surrounds a magnet 13 screwed to the inside of the housing cover by means of a screw connection 14. On the face of the control diaphragm 5 toward the housing cover 2, opposite the magnet 13, there is a small steel plate 15.

Starting from the shown closing position of diaphragm 5, inhalation leads to a downward movement of diaphragm 5 toward the open position shown in broken lines. With the downward movement of diaphragm 5, which moves the valve lever 10 in an opening sense, the force of the slackening compression spring 12 decreases, but so does simultaneously also the opposite force of magnet 13 onto the steel plate 15 as the distance increases. Thereby the resulting opening force exerted on diaphragm 5 and hence the positive pressure prevailing in the respiration chamber 7 and in the connected respirator mask remain approximately unchanged.

While a specific embodiment of the invention has been shown and described in detail to illustrate the application of the principles of the invention, it will be understood that the invention may be embodied otherwise without departing from such principles.

What is claimed is:

1. A lung-controlled valve for respirator masks which have a positive interior mask pressure therein fluidically connected to the user's respiratory organs, comprising a valve housing defining an interior valve cavity, a flexible diaphragm connected to said housing and extending across said valve cavity to divide said cavity into an outer chamber on one side of said diaphragm having an outer chamber wall spaced from said diaphragm and a respiration chamber on the other side of said diaphragm having a respiration chamber wall spaced from said diaphragm, an outlet connected into the respiration chamber, a respirator gas inlet connected into said respiration chamber, valve means in said respirator gas inlet having a valve body with a lever portion engaged with said diaphragm and being movable with said diaphragm to open and close said gas inlet, a magnet secured to said outer chamber wall, a magnetically attractable part arranged on said diaphragm opposite to said magnet, a compression spring disposed between said outer chamber wall and said flexible diaphragm for controlling the movement of said diaphragm for controlling the pressure in the respirator chamber, and a spacer between said outer chamber wall and said diaphragm holding said magnetically attractable part and said diaphragm against movement in the direction of the magnet, under the influence of said magnet, beyond a minimum spacing from said magnet.

2. A lung-controlled valve according to claim 1, wherein said magnet is a permanent magnet.

3. A lung-controlled valve according to claim 1, wherein said magnetically attractable means is a small steel plate surrounded by said diaphragm.

* * * * *